US006486844B2

(12) United States Patent
Thursby et al.

(10) Patent No.: US 6,486,844 B2
(45) Date of Patent: Nov. 26, 2002

(54) HIGH GAIN, FREQUENCY TUNABLE VARIABLE IMPEDANCE TRANSMISSION LINE LOADED ANTENNA HAVING SHAPED TOP PLATES

(75) Inventors: Michael H. Thursby, Palm Bay, FL (US); Sean F. Sullivan, Palm Bay, FL (US); Floyd A. Asbury, Indialantic, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 09/871,047

(22) Filed: May 31, 2001

(65) Prior Publication Data

US 2002/0024472 A1 Feb. 28, 2002

Related U.S. Application Data

(63) Continuation-in-part of application No. 09/643,302, filed on Aug. 22, 2000.

(51) Int. Cl.[7] ..... H01Q 11/12
(52) U.S. Cl. ..... 343/744; 343/741; 343/745
(58) Field of Search ..... 343/700 MS, 728, 343/741, 742, 743, 744, 745, 749, 829, 846, 866, 867

(56) References Cited

U.S. PATENT DOCUMENTS

| | | | | |
|---|---|---|---|---|
| 2,688,083 | A | 8/1954 | Hills | |
| 3,742,393 | A | 6/1973 | Karp | |
| 3,925,738 | A | 12/1975 | Bates et al. | |
| 4,435,689 | A | 3/1984 | McDowell | |
| 4,465,988 | A | 8/1984 | Moates | |
| 4,764,771 | A | 8/1988 | Sterns | |
| 5,061,944 | A | 10/1991 | Powers et al. | |
| 5,790,080 | A | 8/1998 | Apostolos | |
| 6,025,811 | A | 2/2000 | Canora et al. | |
| 6,094,170 | A | 7/2000 | Peng | |
| 6,323,814 | B1 * | 11/2001 | Apostolos | 343/744 |

* cited by examiner

*Primary Examiner*—Tan Ho
*Assistant Examiner*—Shih-Chao Chen
(74) *Attorney, Agent, or Firm*—John L. DeAngelis, Jr.; Beusse Brownlee Bowdoin & Wolter, P.A.

(57) ABSTRACT

There is disclosed a meanderline loaded antenna comprising a ground plane, a non-driven vertical element affixed thereto, a driven vertical element and a shaped top radiating element conductively connected between the driven and non-driven vertical elements. One or more segments or regions of the top plate are resonant depending on the input signal frequency. Since top plate presents several such segments or portions, several different resonant frequencies (a band of closely spaced resonant frequencies or multiple bands of disparate resonant frequencies) are presented to the antenna driving signal, thus allowing the antenna to resonate at several different frequencies and bands. In another embodiment, the antenna comprises a plurality of top radiating elements in parallel spaced relation or in a single plane, wherein each top radiating element is resonant at a different frequency, when considered with the effective lengths of the other antenna elements. Thus the plurality of top radiating plates accommodate multiple resonant frequencies and wideband operation. A plurality of such antennae can be used as elements to form an antenna array. The antenna functions similarly in a receive mode in accordance with the antenna reciprocity therein.

43 Claims, 8 Drawing Sheets

HIGH GAIN, FREQUENCY TUNABLE VARIABLE IMPEDANCE TRANSMISSION LINE LOADED ANTENNA HAVING SHAPED TOP PLATES

This patent application is a continuation-in-part of U.S. patent application Ser. No. 09/643,302 filed on Aug. 22, 2000.

BACKGROUND OF THE INVENTION

The present invention relates generally to antennae comprising a plurality meanderlines (also referred to as variable impedance transmission lines or slow wave transmissions lines), and specifically to such an antenna providing multi-band operation using a simple or complex polygonal or irregularly shaped radiating element or a plurality of such radiating elements.

It is generally known that antenna performance is dependent upon the antenna shape, the relationship between the antenna physical parameters (e.g., length for a linear antenna and diameter for a loop antenna) and the wavelength of the signal received or transmitted by the antenna. These relationships determine several antenna parameters, including input impedance, gain, directivity and the radiation pattern shape. Generally, the minimum physical antenna dimension must be on the order of a quarter-wavelength of the operating frequency, thereby allowing the antenna to be excited easily and to operate at or near its resonant frequency, which in turn limits the energy dissipated in resistive losses and maximizes the antenna gain.

The burgeoning growth of wireless communications devices and systems has created a significant need for physically smaller, less obtrusive, and more efficient antennae that are capable of operation in multiple frequency bands and/or in multiple modes (i.e., having different radiation patterns). As is known to those skilled in the art, there is an inverse relationship between physical antenna size and antenna gain, at least with respect to a single-element antenna. Increased gain requires a physically larger antenna, while users continue to demand physically smaller antennae. As a further constraint, to simplify the system design and strive for minimum cost, equipment designers and system operators prefer to utilize antennae capable of efficient multi-frequency and/or wide bandwidth operation. Finally, it is known that the relationship between the antenna frequency and the antenna length (in wavelengths) determines the antenna gain. That is, the antenna gain is constant for all quarter-wavelength antennae (i.e., at that operating frequency where the antenna length is a quarter of a wavelength).

One prior art technique that addresses some of these antenna requirements is the so-called "Yagi-Uda" antenna, which has been successfully used for many years in applications such as the reception of television signals and point-to-point communications. The Yagi-Uda antenna can be designed with high gain (or directivity) and a low voltage-standing-wave ratio (i.e., low losses) throughout a narrow band of contiguous frequencies. It is also possible to operate the Yagi-Uda antenna in more than one frequency band, provided that each band is relatively narrow and that the mean frequency of any one band is not a multiple of the mean frequency of another band. That is, a Yagi-Uda antenna for operation at multiple frequencies can be constructed so long as the operational frequencies are not harmonically related.

Specifically, in the Yagi-Uda antenna, there is a single element driven from a source of electromagnetic radio frequency (RF) radiation. That driven element is typically a half-wave dipole antenna. In addition to the half-wave dipole element, the antenna has certain parasitic elements, including a reflector element on one side of the dipole and a plurality of director elements on the other side of the dipole. The director elements are usually disposed in a spaced-apart relationship in the transmitting direction or, in accordance with the antenna reciprocity theorem, in the receiving direction. The reflector element is disposed on the side of the dipole opposite from the array of director elements. Certain improvements in the Yagi-Uda antenna are set forth in U.S. Pat. No. 2,688,083 (disclosing a Yagi-Uda antenna configuration to achieve coverage of two relatively narrow non-contiguous frequency bands), and U.S. Pat. No. 5,061,944 (disclosing the use of a full or partial cylinder partially enveloping the dipole element).

U.S. Pat. No. 6,025,811 discloses an invention directed to a dipole array antenna having two dipole radiating elements. The first element is a driven dipole of a predetermined length and the second element is an unfed dipole of a different length, but closely spaced from the driven dipole and excited by near-field coupling. This antenna provides improved performance characteristics at higher microwave frequencies.

One basic antenna model commonly used in many applications today is the half-wavelength dipole antenna. The radiation pattern is the familiar donut shape with most of the energy radiated uniformly in the azimuth direction and little radiation in the elevation direction. The personal communications (PCS) band of frequencies extends from 1710 to from 1990 MHz and 2110 to 2200 MHz. A half-wavelength dipole antenna is approximately 3.11 inches long at 1900 MHz, 3.45 inches long at 1710 MHz and 2.68 inches long at 2200 MHz, and has a typical gain of a 2.15 dBi. A derivative of the half-wavelength dipole is the quarter-wavelength monopole antenna located above a ground plane. The physical antenna length is a quarter-wavelength, but the ground plane changes the antenna characteristics to resemble a half-wavelength dipole. Thus, the radiation pattern for such a monopole is similar to the half-wavelength dipole pattern, with a typical gain of approximately 2 dBi.

The common free space (i.e., not above a ground plane) loop antenna (with a diameter of approximately one-third the wavelength) also displays the familiar donut radiation pattern (along the radial axis) with a gain of approximately 3.1 dBi. At 1900 MHz, this antenna has a diameter of about 2 inches. The typical loop antenna input impedance is 50 ohms, providing good matching characteristics. Finally, another conventional antenna is the patch, which provides directional hemispherical coverage with a gain of approximately 3 dBi. Although small compared to a quarter- or half-wavelength antenna, the patch antenna has a low radiation efficiency.

BRIEF SUMMARY OF THE INVENTION

The present invention discloses an antenna comprising one or more conductive elements, including a horizontal element and at least two oppositely disposed vertical elements, each connected to the horizontal element by a meanderline coupler, and a ground plane. The meanderline coupler has an effective electrical length through the dielectric medium that influences the overall effective electrical length, operating characteristics, and pattern shape of the antenna. Further, the use of multiple vertical elements or multiple meanderline couplers on a single vertical element provides controllable operation in multiple frequency bands.

An antenna comprising meanderline couplers has a smaller physical size, yet exhibits enhanced performance over a conventional dipole. Further, the operational bandwidth is greater than typically available with a patch antenna. Finally, an antenna constructed with two meanderline couplers and more than one horizontal element offers polarization diversity depending on the relationship between the transmitted/received signal and the orientation of the radiating/receiving elements.

A meanderline coupled antenna constructed according to the prior art typically operates in two frequency bands, with a unique antenna pattern for each band (i.e., in one band the antenna has an omnidirectional donut radiation pattern (referred to herein as monopole mode) and in the other band the majority of the radiation is emitted in a hemispherical elevation pattern (referred to as loop mode). According to the teachings of the present invention, the antenna comprises a plurality of horizontal conductors (also referred to as top plates) or a single horizontal conductor with an shape determined by the desired antenna characteristics. The multiple top plates or the shaped top plate provides multiple resonant frequencies or multiple resonant frequency bands and therefore the antenna operates in multiple modes in a single frequency band, dependent upon which one or more of the multiple top plates are excited or in the shaped top plate embodiment, dependent upon the particular segment or region of the shaped top plate that is excited.

BRIEF DESCRIPTION OF THE DRAWINGS

The present invention can be more easily understood and the further advantages and uses thereof more readily apparent, when considered in view of the description of the preferred embodiments and the following figures in which.

DETAILED DESCRIPTION OF THE PREFERRED EMBODIMENTS

Figure 1:
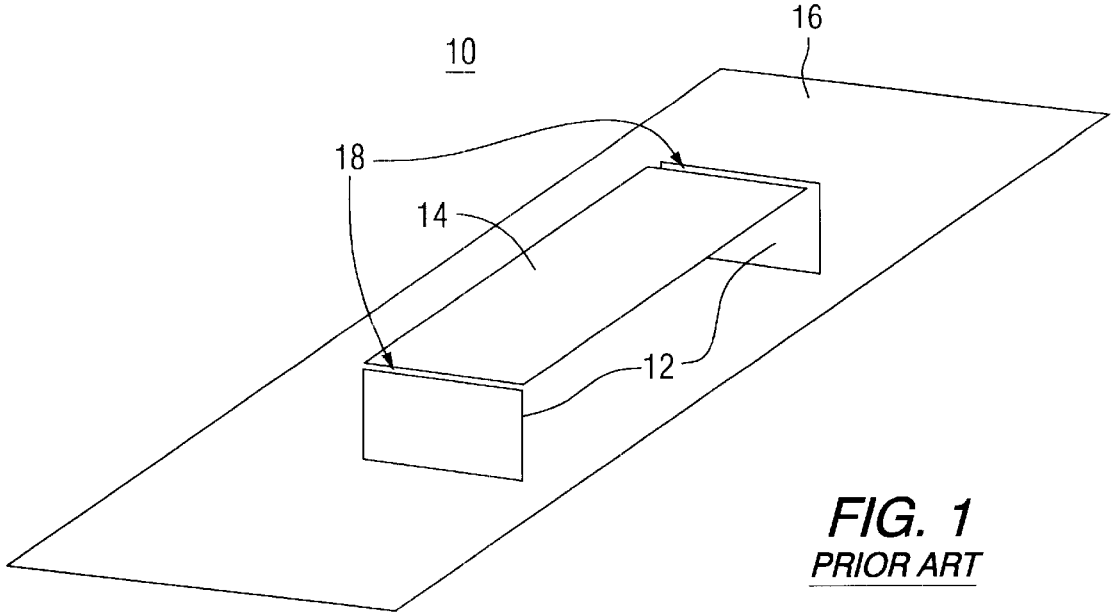
FIG. 1 PRIOR ART
FIG. 1 is a perspective view of a meanderline loaded antenna of the prior art.

Before describing in detail the particular multi-band meanderline loaded antenna constructed according to the teachings of the present invention, it should be observed that the present invention resides primarily in a novel and non-obvious combination of hardware elements related to meanderline loaded antennae and antenna technology in general. Accordingly, the hardware components described herein have been represented by conventional elements in the drawings and in the specification description, showing only those specific details that are pertinent to the present invention, so as not to obscure the disclosure with structural details that will be readily apparent to those skilled in the art having the benefit of the description herein.

Figure 2:
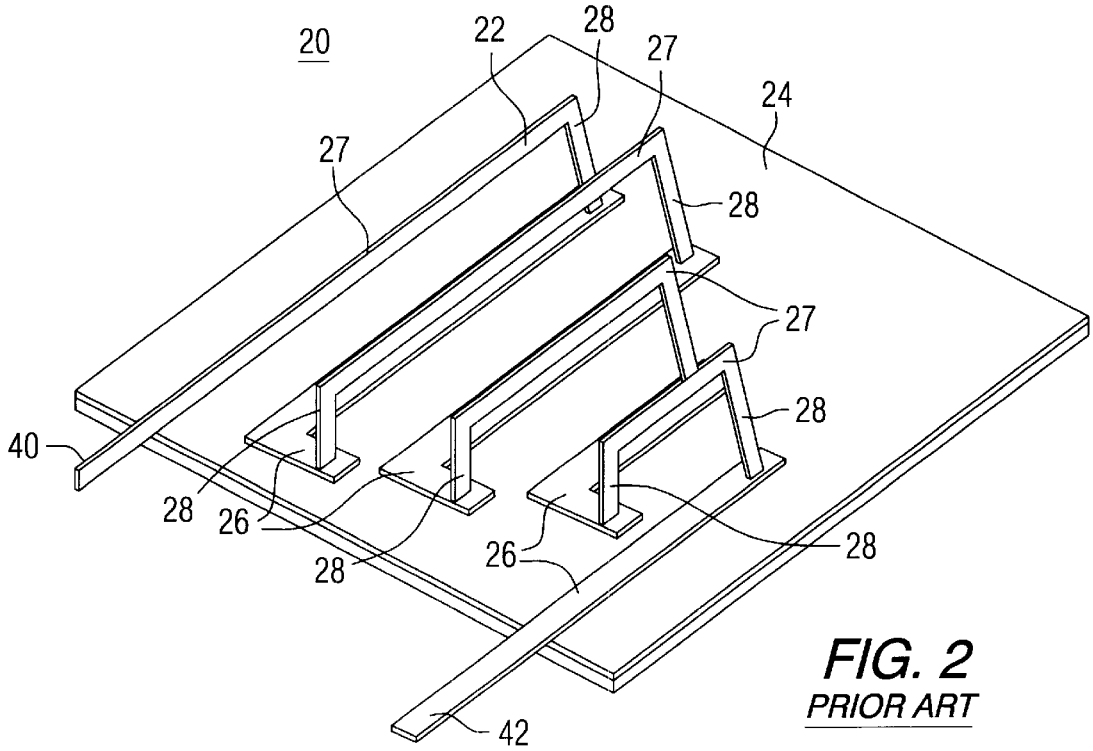
FIG. 2 PRIOR ART
FIG. 2 is a perspective view of a prior art meanderline conductor used as an element coupler in the meanderline loaded antenna of FIG. 1.

FIGS. 1 and 2 depict a prior art meanderline loaded antenna to which the teachings of the present invention can be advantageously applied to provide operation in multiple frequency bands and in multiple simultaneous modes, while maintaining optimum input impedance characteristics.

An example of a meanderline loaded antenna 10, also known as a variable impedance transmission line antenna, is shown in a perspective view in FIG. 1. Generally speaking, the meanderline loaded antenna 10 includes two vertical conductors 12, a horizontal conductor 14, and a ground plane 16. The vertical conductors 12 are physically separated from the horizontal conductor 14 by gaps 18, but are electrically connected to the horizontal conductor 14 by two meanderline couplers, one for each of the two gaps 18, to thereby form an antenna structure capable of radiating and receiving RF (radio frequency) energy. The meanderline couplers electrically bridge the gaps 18 and have controllably adjustable lengths for changing the characteristics of the meanderline loaded antenna 10. In one embodiment of the meanderline coupler, segments of the meanderline can be switched in or out of the circuit quickly and with negligible loss, to change the effective length of the meanderline couplers, thereby changing the antenna characteristics. The switching devices are located in high impedance sections of the meanderline couplers, thereby minimizing the current flow through the switching devices, resulting in very low dissipation losses in the switching devices and maintaining high antenna efficiency.

The operational parameters of the meanderline loaded antenna 10 are substantially affected by the frequency of the input signal as determined by the relationship of the meanderline coupler lengths plus the antenna element lengths to the input signal wavelength. According to the antenna reciprocity theorem, the antenna parameters are also substantially affected by the receiving signal frequency. Two of the various modes in which the antenna can operate are discussed herein below.

Although illustrated in FIG. 1 as having generally rectangular plates, it is known to those skilled in the art that the vertical conductors 12 and the horizontal conductor 14 can be constructed from a variety of conductive materials with a variety of different shapes. For instance, thin metallic conductors having a length significantly greater than their width, could be used as the vertical conductors 12 and the horizontal conductor 14. Single or multiple lengths of heavy gauge wire or conductive material in a filamental shape could also be used.

FIG. 2 shows a perspective view of a meanderline coupler 20 constructed for use in conjunction with the meanderline loaded antenna 10 of FIG. 1, comprising conductors on a dielectric substrate, i.e., microstrip. It is known to those skilled in the art that a meanderline coupler can also be constructed based on stripline technologies. Two meanderline couplers 20 are required for use with the meanderline loaded antenna 10, but is not necessary for the lengths to be equal. Each meanderline coupler 20 is a slow wave meanderline element (also known as a variable impedance transmission line or a slow wave transmission line) in the form of a folded transmission line 22 mounted on a substrate 24, which in turn overlies a plate 25. Sections 26 are mounted close to the substrate 24; sections 27 are spaced apart from the substrate 24. In one embodiment as shown, sections 28, connecting the sections 26 and 27, are mounted orthogonal to the substrate 24. The variation in height of the alternating sections 26 and 27 from the substrate 24 gives the sections 26 and 27 different impedance values with respect to the substrate 24. As shown in FIG. 2, each of the sections 27 is approximately the same distance above the substrate 24. However, those skilled in the art will recognize that this is not a requirement for the meanderline coupler 20. Instead, the various sections 27 can be located at different distances above the substrate 24. Such modifications change the electrical characteristics of the coupler 20 from the embodiment employing uniform distances. As a result, the characteristics of the antenna employing the coupler 20 also change. The impedance presented by the meanderline coupler 20 can be changed by changing the material or the thickness of the microstrip substrate or by changing the width of the sections 26, 27 or 28. In any case, the meanderline coupler 20 must present a controlled (but controllably variable if the embodiment so requires) impedance.

The sections 26, which are located relatively close to the substrate 24 (and thus to the plate 25) create a lower characteristic impedance. The sections 27 are located a controlled distance from the substrate 24, wherein the distance determines the characteristic impedance of the section 27 in conjunction with the other physical characteristics of the folded transmission line 22, as well as the frequency-dependent characteristics of the folded transmission line 22.

Figure 3A:
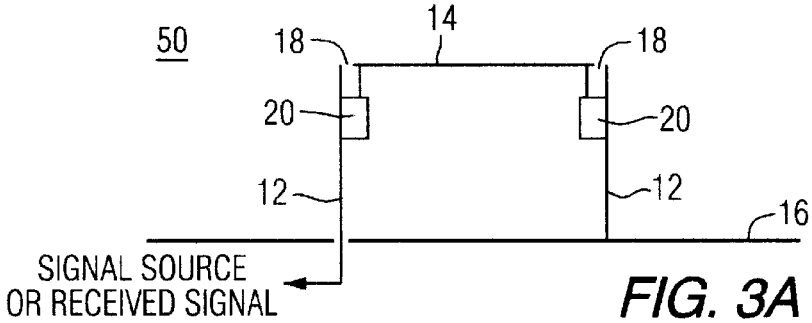
FIG. 3A PRIOR ART
FIGS. 3A through 3B illustrate two embodiments for placement of the meanderline couplers relative to the antenna elements.
Figure 3B:
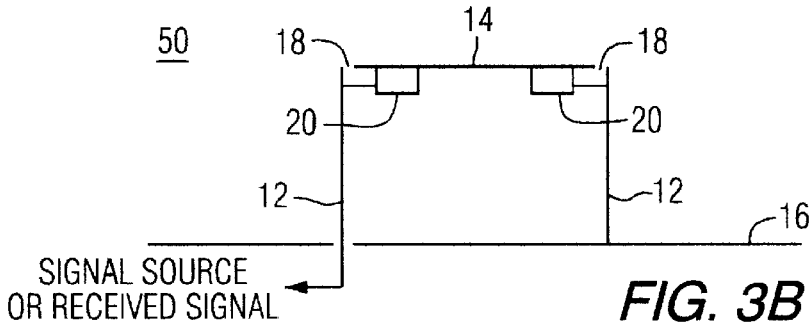
FIG. 3B PRIOR ART

The meanderline coupler 20 includes terminating points 40 and 42 for connection to the elements of the meanderline loaded antenna 10. Specifically, FIG. 3A illustrates two meanderline couplers 20, one affixed to each of the vertical conductors 12 such that the vertical conductors 12 serves as the plate 25 shown in FIG. 2, so as to form a meanderline loaded antenna 50. One of the terminating points shown in FIG. 2, for instance the terminating point 40, is connected to the horizontal conductor 14 and the terminating point 42 is connected to the vertical conductor 12. The second of the two meanderline couplers 20 illustrated in FIG. 3A is configured in a similar manner. FIG. 3B shows the meanderline couplers 20 affixed to the horizontal conductor 14, such that the horizontal conductor 14 serves as the plate 25 of FIG. 2. As in FIG. 3A, the terminating points 40 and 42 are connected to the vertical conductors 12 and the horizontal conductor 14, respectively, so as to interconnect the vertical conductors 12 and the horizontal conductor 14 across the gaps 18. In both FIGS. 3A and 3B, one of the vertical conductors, for example, the vertical conductor 12, includes the signal source feed point when operating in the transmit mode or the point from which the received signal is taken when operating in the receive mode.

Figure 4:
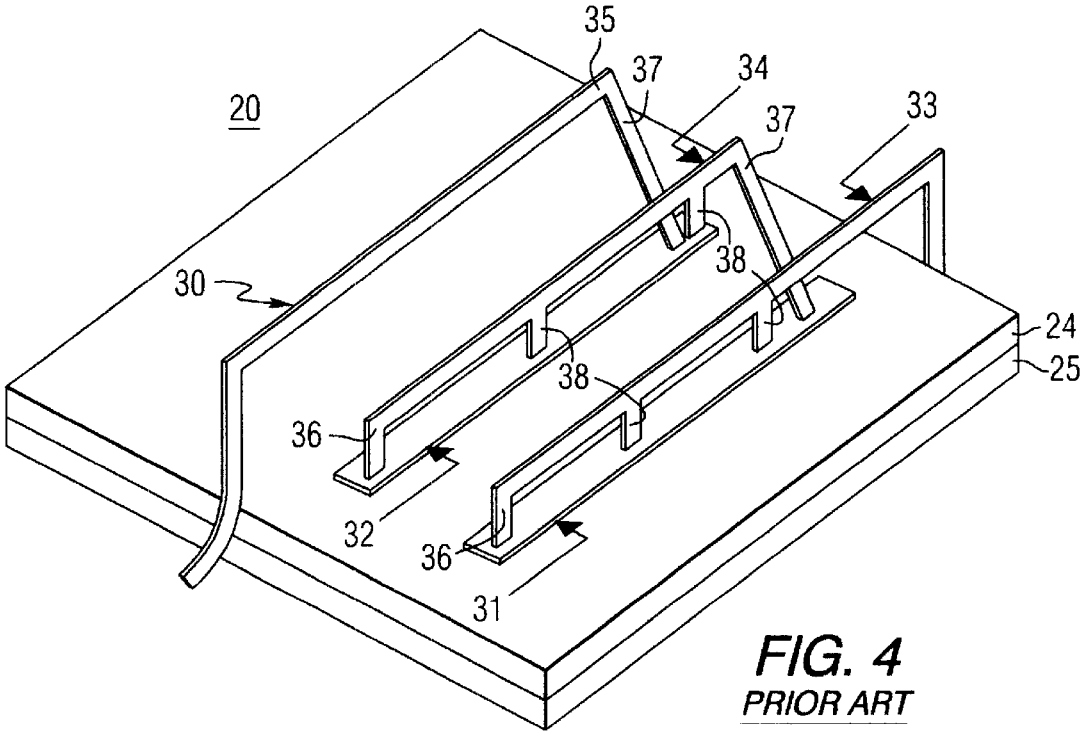
FIG. 4 PRIOR ART
FIG. 4 shows another embodiment of a meanderline coupler.

FIG. 4 is a representational view of a second embodiment of the meanderline coupler 20, including low-impedance sections 31 and 32 and relatively higher impedance sections 33, 34, and 35. The low impedance sections 31 and 32 are located in a parallel spaced apart relationship to the higher impedance sections 33 and 34. The sequential low-impedance sections 31 and 32 and the higher-impedance sections 33, 34, and 35 are connected by substantially orthogonal sections 36 and by diagonal sections 37. The FIG. 4 embodiment includes shorting switches 38 connected between the adjacent low and higher impedance sections 32/34 and 31/33. The shorting switches 38 provide for electronically switchable control of the length of the meanderline coupler 20. As discussed above, the length of the meanderline coupler 20 has a direct impact on the frequency characteristics of the meanderline loaded antenna 50 to which the meanderline couplers 20 are attached, as shown in FIGS. 3A and 3B. As is well known in the art, there are several alternatives for implementing the shorting switches 38, including mechanical switches, microelectromechanical system (MEMS) switches or electronically controllable switches, such as pin diodes. In the embodiment of FIG. 4, all of the low-impedance sections 31 and 32 and the higher-impedance sections 33, 34, and 35 are of approximately equal length, although this is not necessarily required, according to the teachings of the present invention.

The operating mode of the meanderline loaded antenna 50 (in FIGS. 3A and 3B) depends upon the relationship between the operating frequency and the electrical length of the entire antenna, including the meanderline couplers 20. Thus the meanderline loaded antenna 50, like all antennae, has an effective electrical length, that causes it to exhibit operational characteristics determined by the transmit signal frequency in the transmit mode and the received signal frequency in the receiving mode. That is, different operating frequencies excite the antenna so that it exhibits, different operational characteristics, including different antenna radiation patterns. For example, a long wire antenna may exhibit the characteristics of a full-wavelength monopole at a first frequency and exhibit the characteristics of a full-wavelength dipole at a frequency of twice the first frequency.

In accordance with the teachings of the present invention, the length of one or more of the meanderline couplers 20 can be changed (as discussed above) to effect the antenna effective electrical length relative to the operating frequency and in this way change the operational mode without changing the input frequency.

Figure 5:
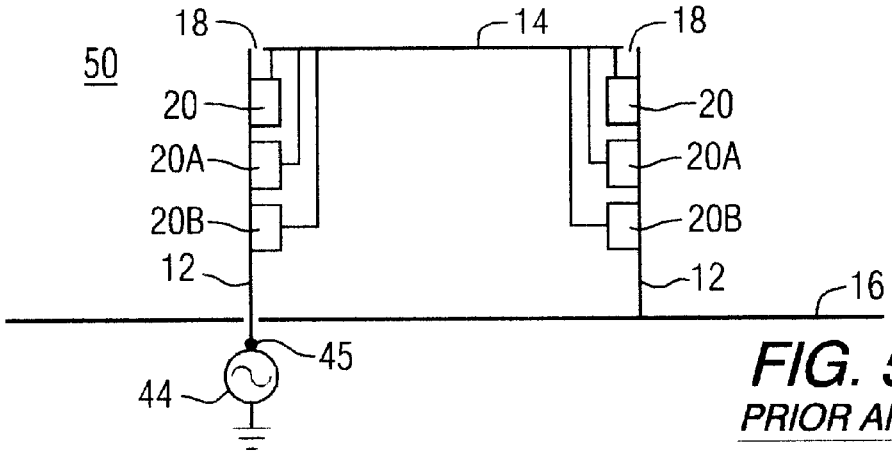
FIG. 5 PRIOR ART
FIG. 5 illustrates the use of a selectable plurality of meanderline couplers with the meanderline loaded antenna of FIG. 1.

Still further, a plurality of meanderline couplers 20 of different effective electrical lengths can be connected between the horizontal conductor 14 and the vertical conductors 12. Two matching meanderline couplers 20 on opposing sides of the horizontal conductor 14 are selected to interconnect the horizontal conductor 14 and the vertical conductors 12 to achieve the desired antenna operating characteristics and radiation pattern. Such an embodiment is illustrated in FIG. 5, including matching meanderline couplers 20, 20A and 20B and an input signal source 44. In the receiving mode the signal source 44 is inactive, and the received signal is available at the terminal 45. A controller (not shown in FIG. 5) is connected to the meanderline couplers 20, 20A and 20B for selecting the operative matching coupler and for changing the length of the selected meanderline coupler as described above. Well-known switching arrangements can activate the selected meanderline coupler. The vertical conductor 12 responsive to the input signal in the transmit mode at the terminal 45 (and providing the received signal at the terminal 45 in the receive mode) is sometimes referred to as the driven element or driven conductor. The other vertical conductor 12 is referred to as the non-driven element or non-driven conductor. In another embodiment both vertical conductors 12 can be driven, with the radiated signal formed as a composite signal depending on the amplitude and phase relationship of the driven signals.

Figure 6:
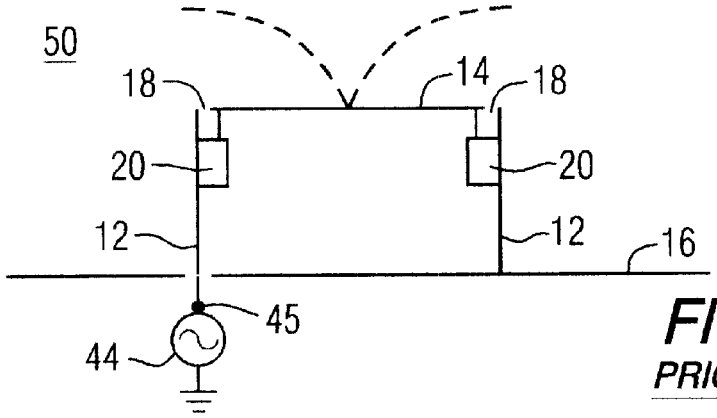
FIG. 6 PRIOR ART
FIGS. 6 through 9 illustrate exemplary operational modes for a meanderline loaded antenna.
Figure 7:
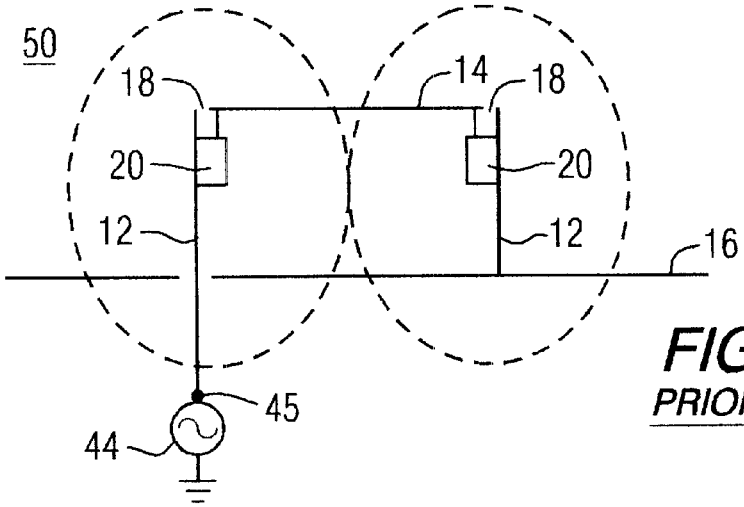
FIG. 7 PRIOR ART

Turning to FIGS. 6 and 7, there is shown the current distribution (FIG. 6) and the antenna electric field radiation pattern (FIG. 7) for the meanderline loaded antenna 50 operating in a monopole or half-wavelength mode as driven by an input signal source 44. That is, in this mode, at a frequency of between approximately 800 and 900 MHz, the effective electrical length of the meanderline couplers 20, the horizontal conductor 14 and the vertical conductors 12 is chosen such that the horizontal conductor 14 has a current null near the center and current maxima at each edge. As a result, a substantial amount of radiation is emitted from the vertical conductors 12, and little radiation is emitted from the horizontal conductor 14. The resulting field pattern has the familiar omnidirectional donut shape as shown in FIG. 7.

Those skilled in the art will realize that a frequency of between 800 and 900 MHz is merely exemplary. The antenna characteristics change when excited by signals at other frequencies because the relationship between the antenna component geometries and the signal frequency changes. Further, the dimensions, geometry and material of the antenna components (the meanderline couplers 20, the horizontal conductor 14 and the vertical conductors 12) can be modified by the antenna designer to create an antenna having different antenna characteristics at other frequencies or frequency bands.

Figure 8:
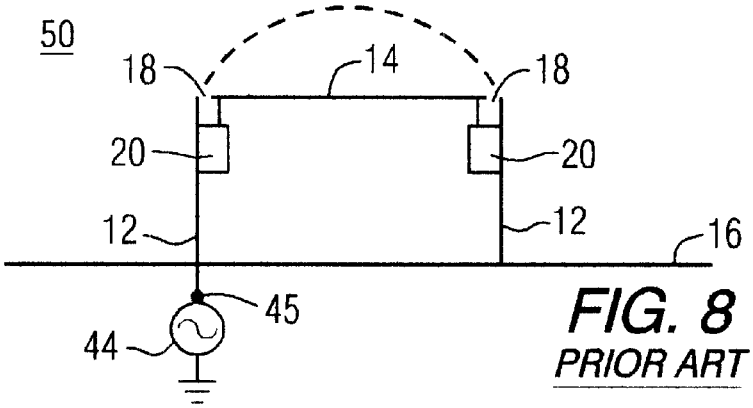
FIG. 8 PRIOR ART
Figure 9:
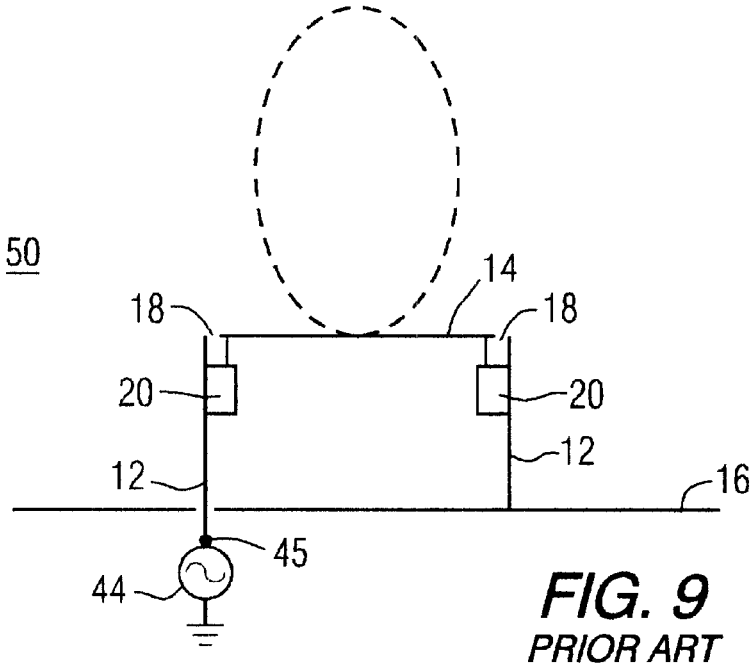
FIG. 9 PRIOR ART

A second exemplary operational mode for the meanderline loaded antenna 50 is illustrated in FIGS. 8 and 9. This mode is the so-called loop mode, operative when the ground plane 16 is electrically large compared to the effective electrical length of the antenna. Note in this mode the current maximum occurs approximately at the center of the horizontal conductor 14 (see FIG. 8) resulting in an electric field radiation pattern as illustrated in FIG. 9. The antenna characteristics displayed in FIGS. 8 and 9 are based on an antenna of the same effective electrical length (including the length of the meanderline couplers 20) as the antenna depicted in FIGS. 6 and 7. Thus, at a frequency of approximately 800 to 900 MHz, the antenna displays the characteristics of FIGS. 6 and 7. For a signal frequency of approximately 1.5 GHz, the same antenna displays the characteristics of FIGS. 8 and 9. By changing the antenna elements, electrical lengths, monopole and loop mode characteristics can be attained at other frequency pairs. Generally, the meanderline loaded antenna exhibits monopole-like characteristics at a first frequency and loop-like characteristics at a second frequency, where there is a loose relationship between the two frequencies, however, the relationship is not necessarily a harmonic relationship. A meanderline-loaded antenna constructed according to FIG. 1 and as further described hereinbelow, exhibits both monopole and loop mode characteristics while typically most prior art antennae operate in only a loop mode or in a monopole mode. That is, if the antenna is in the form of a loop, then it exhibits a loop pattern only. If the antenna has a monopole geometry, then only a monopole pattern can be produced. In contrast, a meanderline-loaded antenna according to the teachings of the present invention exhibits both monopole and loop mode characteristics.

Advantageously, the antenna of the present invention can be operated simultaneously in two different modes dependent on the input signal frequency, that is, in the loop mode and the monopole mode. For example, a meanderline-loaded antenna can be fed from a single input feed point with a composite signal carrying information on two frequencies. In response, the meanderline loaded antenna radiates both signals in different modes, i.e., one signal is radiated according to the loop mode radiation pattern and the other signal is radiated according to the monopole mode radiation pattern. For instance, a signal at about 800 MHz radiates in the monopole mode and simultaneously a signal at about 1500 MHz radiates in the loop mode. Note, that these radiation patterns occur notwithstanding that the top plate length is less than a quarter-wavelength. In the monopole mode the radiation is directed primarily toward the horizon in an omnidirectional pattern, with a gain of approximately 2.5 dBi within the frequency band of approximately 806 to 960 MHz. In the loop mode the radiation is directed primarily overhead (i.e., a hemispherical pattern) at a gain of approximately 4 dBi, within a frequency band of approximately 1500 to 1650 MHz. By changing the geometrical features of a meanderline loaded antenna constructed according to the teachings of the present invention, the antenna can be made operative in other frequency bands, including the FCC-designated ISM band (Industrial, Scientific and Medical) of 2400 to 2497 MHz. In addition to providing pattern control, two antennae constructed according to the teachings of the present invention can be mounted orthogonally, with appropriate coupling, to produce one elliptically or circularly polarized signal, the latter typically useful for satellite communications.

Figure 10:
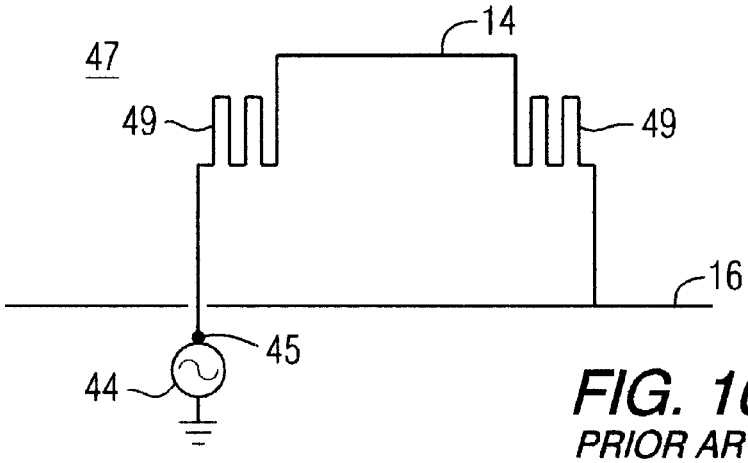
FIG. 10 PRIOR ART
FIG. 10 illustrates another embodiment of a meanderline loaded antenna.

FIG. 10 illustrates yet another meanderline loaded antenna 47 wherein each one of the vertical conductors 12 is replaced by a meanderline coupler 49. That is, the meanderline couplers 49 are conductively connected to the horizontal conductor 14, with one meanderline coupler 49 serving as the driven element. The meanderline couplers 49 are formed, for example, by multiple turns of a conductive material, such a copper, wound around a dielectric, such as a dielectric substrate.

Figure 11:
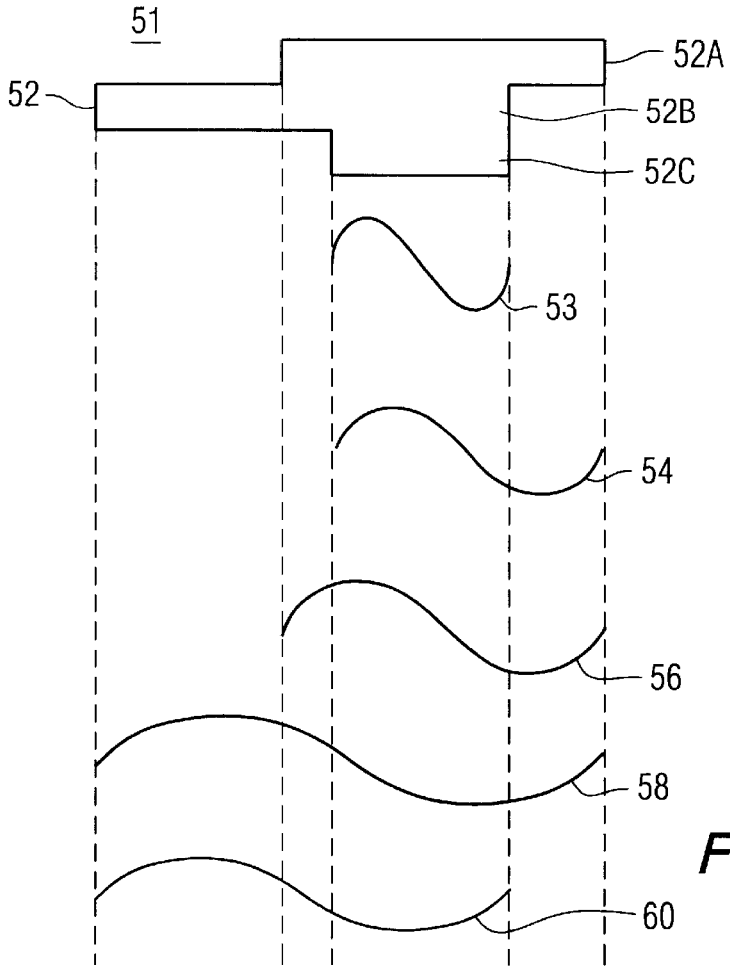
FIGS. 11–21 illustrate several horizontal conductor shapes for the meanderline loaded antenna constructed according to the teachings of the present invention.

FIG. 11 illustrates a shaped horizontal conductor 52 to be used in lieu of the rectangular horizontal conductor 14. As illustrated and discussed above, in one embodiment the horizontal conductor 14, or its alternative, the shaped horizontal conductor 52, is connected to the vertical conductors 12 via the meanderline coupler 20. See for instance FIGS. 3A and 3B. The rectangular horizontal conductor 14 presents a single electrical length as an antenna element. As a result, as discussed above, and illustrated in FIGS. 6, 7, 8 and 9, depending upon the excitation signal frequency, the meanderline loaded antenna can operate in either a monopole or a loop mode. The shaped horizontal conductor can also be employed in the FIG. 10 embodiment.

With the shaped horizontal conductor. 52 illustrated in FIG. 11, several operational frequencies bandwidths, and modes are derivable for the various meanderline-loaded antenna embodiments described herein, for example, the embodiments of FIGS. 3A, 3B, 5, 6, 7, 8, 9 and 10. The shaped horizontal conductor 52 comprises three segments 52A, 52B and 52C. The lengths and the configuration of the various segments 52A through 52C illustrated in FIG. 11 are merely exemplary. The excitation of one or more of the segments 52A through 52C is dependent upon the relationship between the antenna input frequency (or received frequency in the receive mode) and the lengths of the various antenna elements, including the vertical conductors 12, the meanderline couplers 20 and the shaped horizontal conductor 52, including the excited segments or regions thereof.

The waveforms shown in FIG. 11 are representative of how one or more of the segments 52A through 52C can be excited depending upon the frequency of the input signal. For instance, a waveform 53 represents excitation of the segment 52C. A waveform 54 represents excitation of segments 52A and 52C. A waveform 56 represents excitation of the segment 52A. A waveform 58 represents excitation of the segments 52A and 52B. Finally, a waveform 60 represents excitation of the segment 52B. The waveforms shown in FIG. 11 are merely illustrative and ideal. As is known by those skilled in the art, a segment may be excited by a single cycle or multiple half cycles where the wavelength is approximately equal to the length of one or more segments.

The result of using a shaped horizontal conductor 52, is a broadening of the operating bandwidth of the antenna and further the ability to operate in multiple modes (e.g. the monopole mode and the loop mode as mentioned above) at frequencies in addition to those available by using the rectangular horizontal top plate 14. Oversimplifying the effect, for instance, if the segment 52A plus the other antenna elements presents a meanderline loaded loop antenna that is resonant at a first frequency, then a particular antenna pattern is produced. At a second frequency, the segment 52B (plus the other antenna element effective electrical lengths) may present a resonant circuit and produce an antenna beam pattern that is, for example, represented by the monopole mode of FIGS. 6 and 7. At a third frequency the combination of segments 52A and 52B (plus the effective electrical lengths of the other antenna elements) may be resonant at a loop mode frequency as illustrated in FIGS. 8 and 9. However, it is known by those skilled in the art that this explanation is oversimplified. The segments 52A, 52B and 52C are not typically individually and independently excitable. Instead, there is a complex distributed effect as the current flow distributes among the three segments 52A, 52B and 52C and therefore each of the segments 52A, 52B and 52C may contribute to the overall radiation pattern, and expectedly the contributions will not be equivalent.

Figure 12:
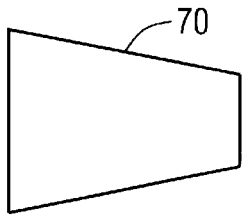

By appropriately shaping the horizontal conductor 52, the antenna can be made to resonate at several different frequencies, in either the loop mode or the monopole mode as desired. One can design an antenna operative over a band of contiguous frequencies by designing the shaped horizontal conductor 52 so that one or more segments or regions of the shaped horizontal conductor 52 (plus the electrical lengths of the remaining antenna elements) is resonant (or reasonably close to resonant to produce an acceptable radiating or receiving antenna) within the frequency band of interest. To create resonance over a band of frequencies the shaped horizontal conductor 52 comprises segments of varying lengths to cover the frequency band of interest. If two closely spaced or adjacent segments are both excited by a given frequency signal, then the operating mode (monopole mode or loop mode) may be the same for each segment. Distantly spaced segments of the shaped horizontal conductor 52 may be excited to operate in different modes. In particular, the trapezoidal horizontal conductor 70 of FIG. 12 serves to provide various length segments for spanning a frequency band of interest. Those skilled in the art are also aware that the other antenna characteristics (e.g., input impedance, losses) are influenced by the operative segment or region of the top plate.

Figure 13:
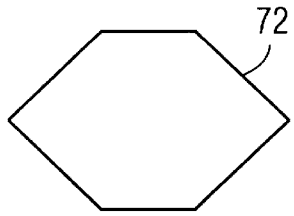

FIG. 13 illustrates another shaped horizontal conductor 72 for use in conjunction with the teachings of the present invention. Both the horizontal conductors 70 and 72 present segments of different lengths such that various antenna resonant frequencies and operating modes are established based on the segment or segments that are excited by the input signal frequency in the transmitting mode (or by the received frequency in the receive mode).

Figure 14:
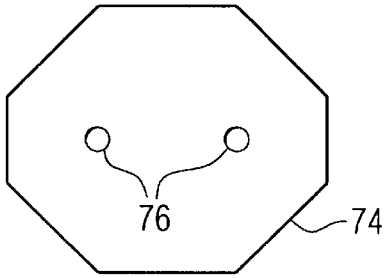
Figure 15:
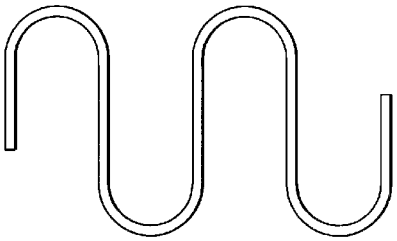
Figure 16:
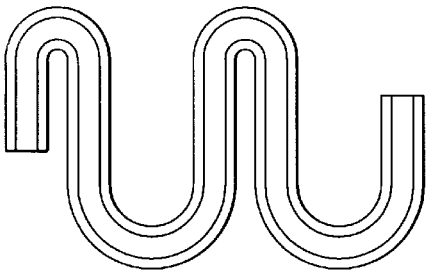

FIG. 14 illustrates another embodiment for a shaped horizontal conductor, referred to by reference character 74. In this embodiment, the horizontal conductor 74 is octagonal and includes two holes 76 that provide a conduit for the current flow across the horizontal conductor 74 and in this way affect the resonant characteristics thereof.

Figure 17:
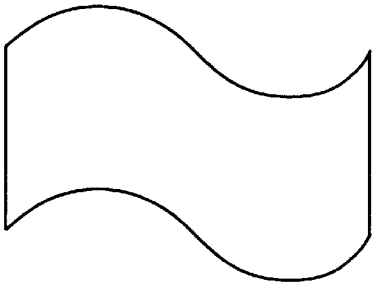
Figure 18:
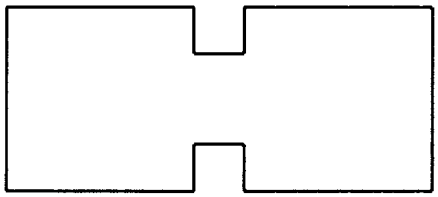
Figure 19:
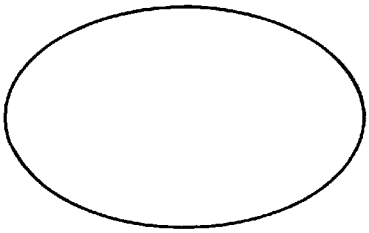
Figure 20:
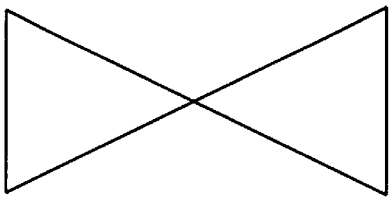
Figure 21:
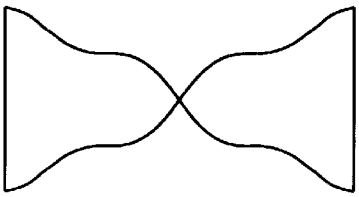

FIGS. 15 through 21 illustrate additional exemplary shapes for use in lieu of the rectangular horizontal top plate 14 shown in FIG. 1. The FIGS. 15 and 16 shapes represent single and dual line top plates constructed from conductive wire or ribbon material. The width of the material and the number of cycles in the pattern are a matter of design choice. FIG. 17 illustrates a wavy top plate. FIG. 18 illustrates a notched top plate. It is not necessary for the FIG. 18 top plate to be symmetrical about the notch. FIG. 19 shows an oval top plate. In one embodiment, the vertical conductors are sized so as not to extend beyond the perimeter of the oval. FIGS. 20 and 21 illustrate, respectively, a bow tie and a wavy bow tie top plate. As discussed above, these are merely exemplary horizontal conductors. Those skilled in the art recognize that the dimensions and shape of the horizontal conductor are determined by the desired antenna operating characteristics.

In addition to the exemplary shapes shown in FIGS. 11 through 21, the rectangular horizontal conductor 14 of FIGS. 1, 3A, 3B and 5 through 9 can be replaced by an irregularly-shaped (i.e., lacking symmetry or evenness) conductor having non-parallel or curved edges. The horizontal conductor can also take the form of a polygon, (wherein the shape is determined by connecting three or more points, each point to the next and the last to the first, with a line segment) or a simple polygon (i.e., one in which no consecutive edges are on the same line and no two edges intersect, except that consecutive edges intersect at the common vertex), a conic section, a surface defined by fractal curves, or a surface defined by a closed curve. The shaped horizontal conductor can also be formed as an inverse of any of these shapes. Each of these horizontal conductor shapes presents one or more segments or regions that can be excited into resonance by signals of different frequencies, thereby providing multi-frequency and wide bandwidth operation. In general, shaped, in the context of the present invention, suggests a bounded surface other than a quadrilateral such that the surface comprises a plurality of segments excitable by different frequencies.

The various shaped horizontal conductor embodiments illustrated in FIGS. 11 through 21 can also be used with multiple meanderline couplers 20, as illustrated in FIG. 5.

Figure 22:
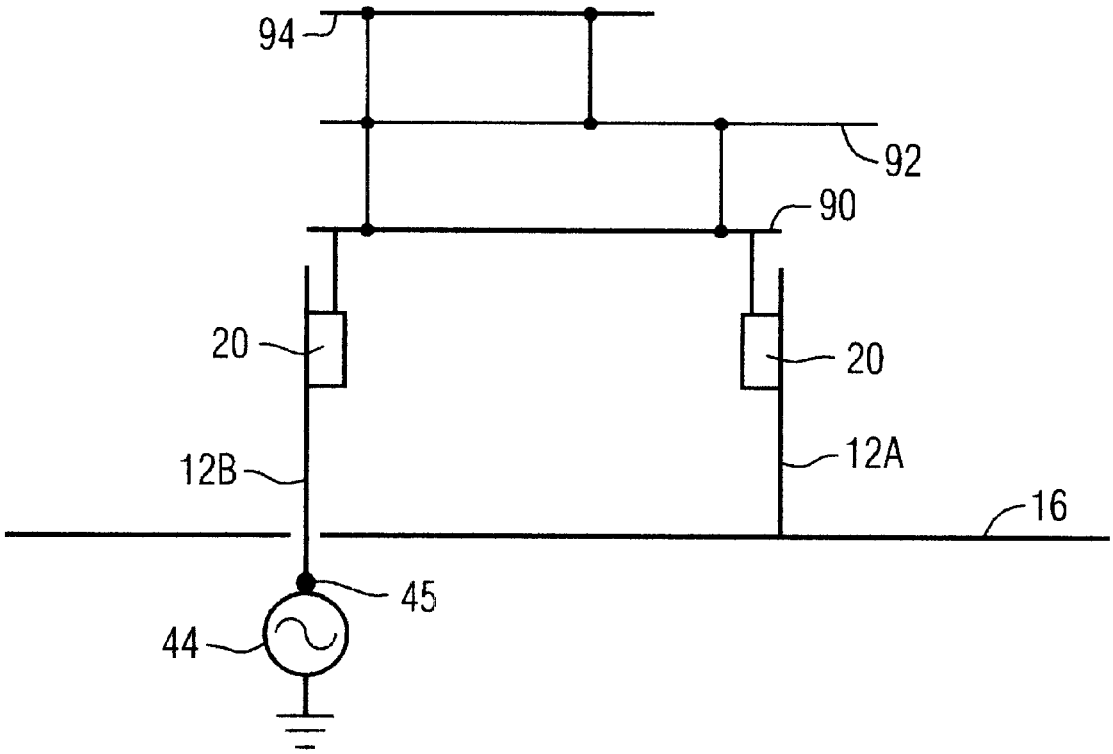
FIGS. 22 and 23 illustrate configurations for the use of a plurality of horizontal conductors with the meanderline loaded antenna of the present invention.

FIG. 22 illustrates another embodiment of the present invention including a plurality of horizontal conductors designated by reference characters 90, 92, and 94. Like the shaped embodiments discussed above, the use of a plurality of horizontal conductor allows the meanderline loaded antenna to operate efficiently at a plurality of signal frequencies with a wide bandwidth at each signal frequency. It is also possible to operate the meanderline loaded antenna of FIG. 22 in either the monopole or loop mode. Although the horizontal conductor 92 is shown as extending beyond the vertical conductor 12A, in another embodiment the horizontal conductor 92 can be extended in the other direction beyond the vertical conductor 12B.

The antenna current, as provided by the input signal 44 distributes between the top plates 90, 92 and 94 in accordance with the impedance presented by these top plates. If the top plates geometries are chosen properly, the antenna bandwidth is broadened.

Figure 23:
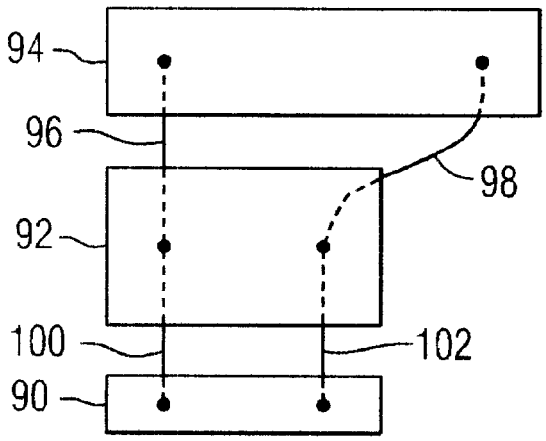

In yet another embodiment, rather than arranging the top plates in a stacked parallel orientation as illustrated in FIG. 22, the horizontal conductors 90, 92 and 94 are oriented side by side in the same plane as shown in FIG. 23. The conductors for interconnecting the horizontal conductors 90, 92 and 94 are identified by reference characters 96 and 98, 100 and 102.

As is known by those skilled in the art, the horizontal conductors 90, 92 and 94 can be interconnected by various techniques. Further, the horizontal conductors 90, 92 and 94 can be formed on a dielectric substrate by the etching, deposition, or printing processes and interconnected with conductive traces on the substrate. The FIG. 23 embodiment has a similar effect on the resonant characteristics of the meanderline loaded antenna as the parallel oriented horizontal conductors illustrated in FIG. 22. Generally, in the antenna embodiments of FIGS. 22 and 23 having the plurality of horizontal conductors, the majority of the transmitted radiation is emitted from these horizontal conductors and thus they are referred to as the radiating elements. But it is known by those skilled in the art that radiation is produced by the other elements of the antennae described herein.

Figure 24:
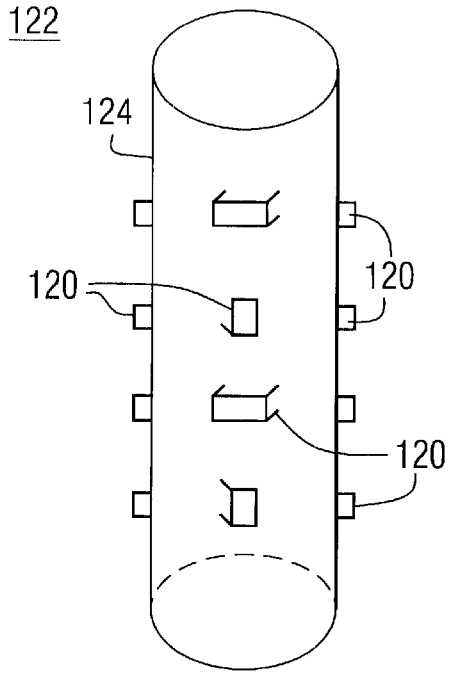
FIGS. 24 and 25 illustrate antenna arrays constructed with the meanderline loaded antennae of the present invention.

FIG. 24 depicts an exemplary embodiment wherein a plurality of meanderline loaded antennae 120 constructed according to the teachings of the present invention (e.g. use of the shaped plates shown in FIGS. 11 through 21, or the multiple plates of FIGS. 22 and 23) are used in, an antenna array 122. The individual meanderline antennae 120 are fixedly attached to a cylinder 124 that serves as the ground plane 16 and further provides a separate signal path to each meanderline antenna 120. In another embodiment not shown, the cylinder 124 is replaced by an elongated structure having, for example, a rectangular or square cross-section. Other cross-sectional shapes can also be utilized in the array configuration. Advantageously, the meanderline antennae 120 are disposed in alternating horizontal and vertically configurations to produce alternating horizontally and vertical polarized signals. That is, the first row of meanderline loaded antennae 120 are disposed horizontally to produce a horizontally polarized signal in the transmit mode and those in the second row are disposed vertically to produce vertically polarized signals in the transmit mode. Operation in the receive mode is in accord with the antenna reciprocity theorem. Although only four rows of the meanderline loaded antennae 120 are illustrated in FIG. 24, those skilled in the art recognize that additional parallel rows can be included in the antenna array 122 so as to provide additional gain. The gain of the antenna array 122 comprises both the element factor and the array factor, as is well known in the art.

Figure 25:
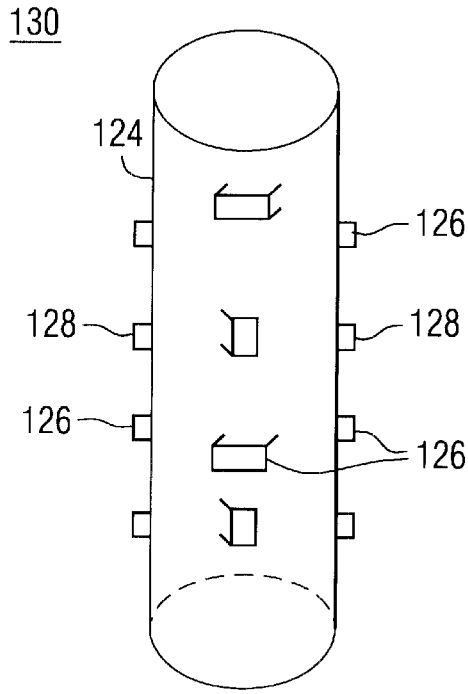

FIG. 25 illustrates yet another antenna array 130 including horizontally oriented elements 126 and vertically oriented elements 128. As can be seen, the horizontally oriented elements 126 are staggered above and below the circumferential element centerline from one consecutive row of horizontal elements to the next. Although consecutive vertical elements 128 are shown in a linear orientation, they too can be staggered. Staggering of the elements provides improved array performance. Further, in both the FIGS. 24 and 25 embodiments, two meanderline-loaded antennae constructed according to the present invention can be oriented, one above the other, dimensioned appropriately and driven to provide a circularly or elliptically polarized signal.

While the invention has been described with reference to preferred embodiments, it will be understood by those skilled in the art that various changes may be made and equivalent elements may be substituted for elements thereof without departing from the scope of the present invention. In addition, modifications may be made to adapt a particular situation to the teachings of the invention without departing from the essential scope thereof. Therefore, it is intended that the invention not be limited to the particular embodiments disclosed, but that the invention will include all embodiments falling within the scope of the appended claims.

What is claimed is:

1. An antenna comprising:

a conductive plate;

a first conductive element having a first edge;

a second conductive element having a first edge electrically connected to said conductive plate said second conductive element further including a second edge opposingly spaced apart from the first edge of said second conductive element;

a shaped conductive element having a plurality of independently excitable regions, wherein current flow through one or more of said regions determines the effective length of the antenna, and wherein a first location of said shaped conductive element spaced proximate to the first edge of said first conductive element so as to create a gap there between, and wherein a second location of said shaped conductive element is spaced proximate to the second edge of said second conductive element so as to create a gap there between;

a first meanderline coupler electrically connected between said first conductive element and said shaped conductive element so as to provide a path across the gap there between;

second meanderline coupler electrically connected between said second conductive element and said shaped conductive element so as to provide a conductive path across the gap there between; and wherein said first and said second meanderline couplers have a selectable electrical length.

2. The antenna of claim 1 wherein the shaped conductive element is substantially equidistant at all points from the conductive plate, and disposed above the conductive plate, and wherein the conductive plate forms a ground plane.

3. The antenna of claim 1 further comprising a controller for selecting the electrical length of the first and the second meanderline couplers.

4. The antenna of claim 1 wherein the distance between the conductive plate and the shaped conductive element is chosen to achieve certain antenna characteristics.

5. The antenna of claim 1 wherein the shape of the top shaped conductive element is selected to achieve certain antenna operating characteristics.

6. The antenna of claim 1 wherein the sum of the effective electrical length of the conductive plate, plus the effective electrical length of the first conductive element, plus the effective electrical length of the shaped conductive element, plus the effective electrical length of the second conductive element presents an antenna resonant condition.

7. The antenna of claim 1 wherein the effective electrical length of the conductive plate, the first conductive element, the second conductive element and the shaped conductive element present an approximately resonant condition at two spaced-apart frequencies.

8. The antenna of claim 1 having a substantially omnidirectional radiation pattern, at a first frequency, and a substantially hemispherical radiation pattern at a second frequency.

9. The antenna of claim 1 wherein the shaped conductive element has a trapezoidal shape.

10. The antenna of claim 1 wherein the shaped conductive element has a polygon shape.

11. The antenna of claim 1 wherein the shaped conductive element has a simple polygon shape.

12. The antenna of claim 1 wherein the shaped conductive element has the shape of a conic section.

13. The antenna of claim 1 wherein the shaped conductive element is in the shape of two triangles joined at a common vertex.

14. The antenna of claim 1 wherein the shape of the shaped conductive element is in the form of a closed curve.

15. The antenna of claim 14 wherein the closed curve is formed from line segments.

16. The antenna of claim 1 further comprising:

a first plurality of meanderline couplers connected between the first conductive element and the shaped conductive element in parallel with the first meanderline coupler;

a second plurality of meanderline couplers connected between the second conductive element and the shaped conductive element in parallel with the second meanderline coupler; and a controller for activating either the first meanderline coupler or one of the first plurality of meanderline couplers, and for activating either the second of the second plurality of meanderline couplers.

17. The antenna of claim 1 wherein the first meanderline coupler and the second meanderline coupler comprise folded slow-wave transmission lines.

18. The antenna of claim 1 wherein the first meanderline coupler and the second meanderline coupler have a controllable effective length.

19. The antenna of claim 1 wherein the first conductive element is responsive to a signal to be transmitted when the antenna is operative in a transmit mode, and wherein the first conductive element provides a received signal when the antenna is operative in a receive mode.

20. The antenna of claim 1 wherein one or more regions of the shaped conductive element are excited by signals transmitted from or received by the antenna.

21. The antenna of claim 1 wherein one or more regions of the shaped conductive element resonate in response to signals transmitted from or received by the antenna.

22. The antenna of claim 1 wherein the shaped conductive element includes a plurality of holes therein.

23. An antenna comprising:

a conductive plate;

a first conductive element including a first edge;

a second conductive element including a first edge electrically connected to said conductive plate, said second conductive element further including a second edge spaced apart from the first edge of said second conductive element;

a first radiating element, wherein a first region of said first radiating element is spaced proximate to the first edge of said first conductive element so as to create a gap there between, wherein a second region of said first radiating element is spaced proximate to the second edge of said second conductive element so as to create a gap there between;

a first meanderline coupler conductively connected between said first conductive element and said first radiating element so as to provide a conductive path across the gap there between;

a second meanderline coupler conductively connected between said second conductive element and said first radiating element so as to provide a conductive electrical path across the gap there between; and a second radiating element conductively connected at two spaced apart points to said first radiating element, wherein said first-and said second radiating elements cooperate to form the antenna radiating element.

24. The antenna of claim 23 wherein the second radiating element is oriented substantially parallel to the first radiating element.

25. The antenna of claim 23 wherein the second radiating element is oriented in substantially the same plane, as the first radiating element.

26. The antenna of claim 23 wherein the first and the second radiating elements are disposed on a dielectric substrate.

27. The antenna of claim 23 wherein the shape of the first radiating element is selected from among a closed curve, an irregular closed curve, a polygon and a simple polygon.

28. The antenna of claim 23 wherein the shape of the second radiating element is selected from among a closed curve, an irregular closed curve, a polygon and a simple polygon.

29. The antenna of claim 23 wherein one or more regions of the first and the second radiating elements are resonant in response to predetermined signal frequencies.

30. An antenna array comprising;

a groundplane;

a plurality of antenna elements, wherein each antenna element comprises:

a first conductive element including a first edge;

a second conductive element including a first edge connected to said ground plane, said second conductive element further including a second edge spaced apart from the first edge of said second conductive element;

at least one radiating element having a shape selected from a closed curve, a polygon a simple polygon and an irregularly bounded surface and, through one or more of said regions determines the effective length of each antenna element, and wherein a first location of said at least one radiating element is spaced proximate to the first edge of said first conductive element so as to create a gap there between, and wherein a second location of said at least one top radiating element is spaced proximate to the second edge of said second conductive element so as to create a gap there between;

a first meanderline coupler conductively connected between said first conductive element and said at least one radiating element so as to provide a conductive path across the gap there between;

second meanderline coupler conductively connected between said second conductive element and said at least one radiating element so as to provide a conductive path across the gap there between; and wherein said first and said second meanderline couplers have a selectable effective electrical length.

31. The antenna array of claim 30 wherein a first number of the plurality of antenna elements are oriented for vertical polarization, and wherein a second number of the plurality of antenna elements are oriented for horizontal polarization.

32. The antenna array of claim 30 wherein the ground plane has a cylindrical cross-section, and wherein a first number of the plurality of the antenna elements are spaced circumferentially around the ground plane at a first axial location, and wherein a second number of the plurality of antenna elements are spaced circumferentially around the ground plane at a second axial location, spaced apart from said first axial location.

33. The antenna array of claim 30 wherein the ground plane has a rectangular cross-section.

34. The antenna array of claim 30 wherein the ground plane has a cylindrical cross-section, and wherein a first number of the plurality of antenna elements are spaced circumferentially around the ground plane such that said first number are staggered about a first axial location, and wherein a second number of the plurality of antenna elements are spaced circumferentially around the ground plane at a second axial location, spaced apart from said first axial location.

35. The antenna array of claim 34 wherein the first number of the plurality of antenna elements includes four antenna elements spaced circumferentially at 90 degrees apart.

36. The antenna array of claim 34 wherein the second number of the plurality of antenna elements includes four antenna elements spaced circumferentially at 90 degrees apart.

37. An antenna comprising:

a conductive plate;

a first meanderline coupler having a first terminal responsive to a signal when said antenna is operative in a transmitting mode and for providing a signal when said antenna is operative in a receiving mode, and further having a second terminal;

a second meanderline coupler having a first terminal conductively connected to said conductive plate and further having a second terminal;

a shaped conductive element conductively connected to the second terminal of said first meanderline coupler at a first location and conductively connected to the second terminal of said second meanderline coupler at a second location, wherein said shaped conductive element comprises a plurality of independently excitable regions, and wherein current flow through one or more of said regions determines the effective length of the antenna; and wherein said first and said second meanderline couplers have independently selectable effective electrical lengths.

38. The antenna of claim 37 wherein the shaped conductive element has a shape selected from among a simple polygon, a complex polygon, a fractal-bounded curve, curve bounded by a plurality of line segments, and an irregular closed curve.

39. The antenna of claim 37 wherein the shaped conductive element has a shape designed to produce certain antenna characteristics.

40. The antenna of claim 37 further comprising a controller for selecting the electrical length of the first and the second meanderline couplers.

41. An antenna comprising:

a conductive plate;

a first meanderline coupler having a first terminal responsive to a signal when said antenna is operative in a transmitting mode and for receiving a signal when said antenna is operative in a receiving mode, and further having a second terminal;

a second meanderline coupler having a first terminal in electrical connection with said conductive plate and further having a second terminal;

a first radiating element in electrical connection with the second terminal of said first meanderline coupler at a first location and in electrical connection with the second terminal of said second meanderline coupler at a second location; and a second radiating element electrically connected to said first radiating element at two spaced apart points.

42. The antenna of claim 41 wherein the second radiating element is oriented substantially parallel to the first radiating element.

43. The antenna of claim 41 wherein the second radiating element is oriented in substantially the same plane as the first radiating element.

* * * * *